US008444109B2

(12) United States Patent
Schaeper

(10) Patent No.: US 8,444,109 B2
(45) Date of Patent: May 21, 2013

(54) BLOWOUT PREVENTER TRANSLATING SHAFT LOCKING SYSTEM

(75) Inventor: Gary R. Schaeper, Tomball, TX (US)

(73) Assignee: T-3 Property Holdings, Inc., Houston, TX (US)

( * ) Notice: Subject to any disclaimer, the term of this patent is extended or adjusted under 35 U.S.C. 154(b) by 169 days.

(21) Appl. No.: 13/020,325

(22) Filed: Feb. 3, 2011

(65) Prior Publication Data

US 2012/0199762 A1 Aug. 9, 2012

(51) Int. Cl.
*E21B 33/06* (2006.01)

(52) U.S. Cl.
USPC ..... 251/1.3; 251/102; 166/85.4

(58) Field of Classification Search
USPC ..... 251/1.1, 1.3, 102; 166/363, 364, 166/85.4
See application file for complete search history.

(56) References Cited

U.S. PATENT DOCUMENTS 2,019,163 A * 10/1935 Slater ..... 91/317
3,208,357 A * 9/1965 Allen et al. ..... 92/27
3,941,141 A * 3/1976 Robert ..... 137/1
4,052,995 A * 10/1977 Ellison ..... 137/1
4,076,208 A * 2/1978 Olson ..... 251/1.3
4,293,115 A * 10/1981 Parks et al. ..... 251/1.3
4,523,639 A 6/1985 Howard, Jr.
4,969,627 A * 11/1990 Williams, III ..... 251/1.3
7,300,033 B1 11/2007 Whitby et al.

OTHER PUBLICATIONS

Garrido Garcia, M., International Search Report for International Patent Application No. PCT/US2012/022003, dated Feb. 1, 2013, European Patent Office.
Garrido Garcia, M., Written Opinion for International Patent Application No. PCT/US2012/022003, dated Feb. 1, 2013, European Patent Office.

* cited by examiner

*Primary Examiner* — John K Fristoe, Jr.
*Assistant Examiner* — Umashankar Venkatesan
(74) *Attorney, Agent, or Firm* — Locke Lord LLP

(57) ABSTRACT

The disclosure provides a blowout preventer (BOP) system with an actuator for opening and closing a ram. The actuator includes a locking system having a clutch piston to operate a clutch having ratcheting teeth. The locking system disengages the clutch prior to the ram opening and closing. The clutch piston has a first portion with a larger area than a second portion. A clutch fluid pressure acts on the first portion, and a closing fluid pressure acts on the second portion. This area difference in the clutch piston portions allows the clutch to be disengaged during closing operations, even when the closing fluid pressure is the same as the clutch fluid pressure and the clutch is biased engaged by a bias assembly. Further, closing fluid pressure is applied to lessen the load on the clutch ratcheting teeth, while the clutch fluid pressure is applied to unlock the clutch.

26 Claims, 11 Drawing Sheets

BLOWOUT PREVENTER TRANSLATING SHAFT LOCKING SYSTEM

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The disclosure generally relates oil field equipment. More particularly, the disclosure relates to the blowout preventers.

2. Description of the Related Art

In gas and oil wells, it is sometimes necessary to close around or shear a tubular member disposed therein and seal the wellbore to prevent an explosion or other mishap from subsurface pressures. Typically, the oil field equipment performing such a function is known as a blowout preventer. A blowout preventer has a body that typically is mounted above a well as equipment in a blowout preventer stack.

A typical blowout preventer has a body with a bore through which a drill pipe or other tubular member can extend. Different types of rams, typically pipe, blind, or shearing sealing are associated with blowout preventers. Generally, a pair of rams extend laterally (that is, at some non-zero angle to the bore) from opposite sides of the bore. The rams are able to move axially within guideways and laterally to the bore. A pair of actuators connected to the body at the outer ends of the rams cause the rams to move laterally, and close around or shear the drill pipe disposed therebetween. A ram commonly have one or more sealing surfaces that seal against an object, the body of the blowout preventer, and an opposing ram. For example, shear blades on at least one type of ram are typically at slightly different elevations, so that one shear blade passes slightly below the other shear blade to cause the shearing action of an pipe or object disposed between the rams. After the shearing, sealing surfaces on the rams can seal against each other, so that the pressure in the well is contained and prevented from escaping external to the well bore.

Ram-type BOPs are required to have a device that mechanically locks and holds the sealing members of the BOP in the closed position. This mechanical lock acts as a safety precaution in the case of loss of hydraulic operating pressure to the actuators. The combination of accumulation of component tolerances and various sealing devices on the rams dictates that the mechanical locking device has to be able to lock the sealing components in a large range of positions. Thus, an axially movable lock is used.

Small, but important improvements thereafter characterized the industry. U.S. Pat. No. 4,076,208 to Olson is an example of the art that exists for these types of systems that have been used commercially. The Abstract states, "A new and improved ram lock for blowout preventer rams which permits locking of the ram at multiple and adjustable positions to compensate for wear on sealing elements of blowout preventer rams and increase sealing action of the ram without requiring separate special control lines. Automatic locking of the ram at a desired position, such as in adjustable sealing positions to compensate for ram elastomer wear, is obtained."

Olson acknowledges that prior art U.S. Pat. No. 3,242,826 and Re27,294 teaches snap rings or collets that locked when the piston in the actuator reached a predetermined locking position, but offered only one locking position. Olson also acknowledges that U.S. Pat. No. 3,208,357 teaches a blowout preventer with a taper locking pin, but requires extra hydraulic operating and control lines, increasing the complexity of the control system. In Olson, the text and figures teach a lock that is activated by engagement of ratchet teeth 38*a*, 42*a* on engaged clutch plates 38, 42, as illustrated in FIGS. 2, 4. Springs 40 maintain contact between the ratchet teeth 38*a*, 42*a* during rest and during inward movement of the ram toward the center of the BOP. As the ram moves inwardly and the lock nut 40 rotates, the ratchet teeth 38*a*, 42*a* incrementally index relative to each other, allowing ram movement inwardly, but locking ram movement outwardly by locking the nut 40 from reverse rotation. To release the ratchet teeth so that the ram can move in the reverse direction outwardly, an annular unlocking piston 62 in an unlocking chamber 60 is actuated and forces the clutch plates and ratchet teeth apart, as shown in FIG. 2A. The pressure on the unlocking piston is the opening or clutch fluid pressure in the cylinder 17 from fluid entering through the inlet conduit 24*b*. Such fluid is conveyed at such pressure to the unlocking chamber 60 to actuate the unlocking piston 62, as the ram begins to movement outwardly.

However, such a locking system may be subjected to high loads when the BOP is closed and opened, which may reduce the service life of the locking system. The system described by Olson applies the opening fluid pressure to the unlocking piston, when such opening fluid pressure is also applied to the ram carrier to try to force the ram outwardly. Thus, the pressure on the ram carrier can increase the force between the ratchet teeth to resist such force, because the ratchet teeth are locked together to prevent the ram from moving outwardly. While the ratchet teeth are locked together under such force, the unlocking piston is trying to overcome such force to disengage the ratchet teeth. Thus, the system causes such parts to oppose each other's intended movement until the unlocking piston can disengage the ratchet teeth to allow the outward movement of the ram. The system can create wear on the ratchet teeth as the ratchet teeth engage and disengage each other. Further, the ratchet teeth are continually engaged during the inward movement of the ram, further contributing to potential wear on the system.

Therefore, there remains a need for improved locking system for a blowout preventer that reduces the potential wear on the locking system and activates the clutch engagement in a more controlled manner.

BRIEF SUMMARY OF THE INVENTION

The disclosure provides a blowout preventer (BOP) system with an actuator for opening and closing a ram. The actuator includes a locking system having a clutch piston to operate a clutch having ratcheting teeth. The locking system disengages the clutch prior to the ram opening and closing. The clutch piston has a first portion with a larger area than a second portion. A clutch fluid pressure acts on the first portion, and a closing fluid pressure acts on the second portion. This area difference in the clutch piston portions allows the clutch to be disengaged during closing operations, even when the closing fluid pressure is the same as the clutch fluid pressure and the clutch is biased engaged by a bias assembly.

Further, closing fluid pressure is applied to lessen the load on the clutch ratcheting teeth, while the clutch fluid pressure is applied to unlock the clutch.

When operations require that the clutch be engaged, the removal of the clutch fluid pressure allows the BOP closing fluid pressure to displace the clutch piston to a position that allows a ratcheting clutch plate to engage an overhauling nut and only allow the overhauling nut to rotate in the BOP closing direction and lock the BOP in such closed position. This disclosure also provides for the application of BOP closing fluid pressure prior to unlocking the locked clutch on the BOP. Closing fluid pressure can be reduced and opening fluid pressure can be applied to open the ram while the clutch fluid pressure maintains pressure on the clutch piston to keep the clutch disengaged. The system assists in reducing wear associated with the locking assembly on the BOP.

The disclosure provides a blowout preventer for an oil or gas well, comprising a blowout preventer body having an opening disposed therethrough for a tubular product to be inserted through the opening and having at least a first guideway formed at an angle to a centerline of the opening; a first ram slidably coupled to the blowout preventer body along the first guideway formed in the body; and a first actuator coupled to the first ram and adapted to move the first ram along the first guideway in a lateral direction between an open position and a closed position. The first actuator comprises an actuator body having a sleeve disposed at an angle to a centerline of the opening sleeve formed therein; an actuator piston; a locking nut rotatable relative to the actuator piston; and a clutch assembly selectively coupled with the locking nut and adapted to restrain rotation of the locking nut. The actuator piston comprises an actuator piston head slidably disposed at least partially within the sleeve and sealingly engaged with the sleeve, a first end of the actuator piston being coupled to the first ram, and a second end of the actuator piston being coupled to a threaded shaft having threads formed on the shaft; the actuator piston head dividing the sleeve into an inward chamber within the sleeve in a direction toward the centerline of the opening and an outward chamber within the sleeve in a direction away from the centerline of the opening. The locking nut comprises corresponding threads adapted to engage the threads on the threaded shaft of the actuator piston and adapted to allow the threaded shaft to move laterally with the actuator piston head as the locking nut rotates relative to the threaded shaft. The clutch assembly comprises a clutch plate having a gripping surface disposed toward the locking nut; a bias assembly comprising a bias member and a bias member retainer coupled to the bias member, the bias assembly adapted to bias the clutch plate toward the locking nut; and a clutch piston slidably coupled with the actuator body and adapted to selectively engage the clutch plate with the locking nut. The clutch piston comprises a first portion with a first pressure area and a second portion with a second pressure area, a difference between the first pressure area and the second pressure area forming a differential pressure area, the first pressure area being sealed from the second pressure area, the first pressure area being fluidicly coupled to a port to provide fluid pressure to the first pressure area independent of fluid pressure on the second pressure area.

The disclosure also provides a method of actuating a blowout preventer for an oil or gas well, the blowout preventer comprising a blowout preventer body having an opening for inserting a tubular product therethrough, at least one ram slidably coupled to the blowout preventer body, a first actuator adapted to move the ram between an open position and a closed position; the actuator having an actuator body with an actuator piston disposed therein, the actuator piston having an actuator piston head dividing an internal portion of the actuator body into an inward chamber in a direction toward the opening from the actuator piston head and an outward chamber in a direction away from the opening from the actuator piston head, the actuator piston further having a threaded portion adapted to engage a threaded locking nut rotatable relative to the actuator body, the actuator further having a clutch assembly having a clutch plate selectively coupled with the locking nut, and a locking piston having a first portion with a first pressure area and a second portion with a second pressure area, a difference between the first pressure area and the second pressure area forming a differential pressure area, the first pressure area being sealed from the second pressure area, the method, starting from an open position, comprising: applying a clutch fluid pressure to the first portion of the clutch piston to move the clutch piston; disengaging the clutch plate from the locking nut with the clutch piston; applying a closing fluid pressure to the actuator piston from the outward chamber while the clutch plate is disengaged from the locking nut; and moving the ram inward toward the opening to at least partially close the blowout preventer; and reducing the clutch fluid pressure to the first portion of the clutch piston to allow the clutch plate to engage the locking nut and maintain the ram in an at least partially closed position.

DETAILED DESCRIPTION

The Figures described above and the written description of specific structures and functions below are not presented to limit the scope of what Applicant has invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present disclosure will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of ordinary skill in this art having benefit of this disclosure. It must be understood that the inventions disclosed and taught herein are susceptible to numerous and various modifications and alternative forms. The use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims.

The disclosure provides a blowout preventer (BOP) system with an actuator for opening and closing a ram. The actuator includes a locking system having a clutch piston to operate a clutch having ratcheting teeth. The locking system disengages the clutch prior to the ram opening and closing. The clutch piston has a first portion with a larger area than a second portion. A clutch fluid pressure acts on the first portion, and a closing fluid pressure acts on the second portion. This area difference in the clutch piston portions allows the clutch to be disengaged during closing operations, even when the closing fluid pressure is the same as the clutch fluid pressure and the clutch is biased by a bias assembly to an engaged position. Further, closing fluid pressure is applied to lessen the load on the clutch ratcheting teeth, while the clutch fluid pressure is applied to unlock the clutch.

Figure 1:
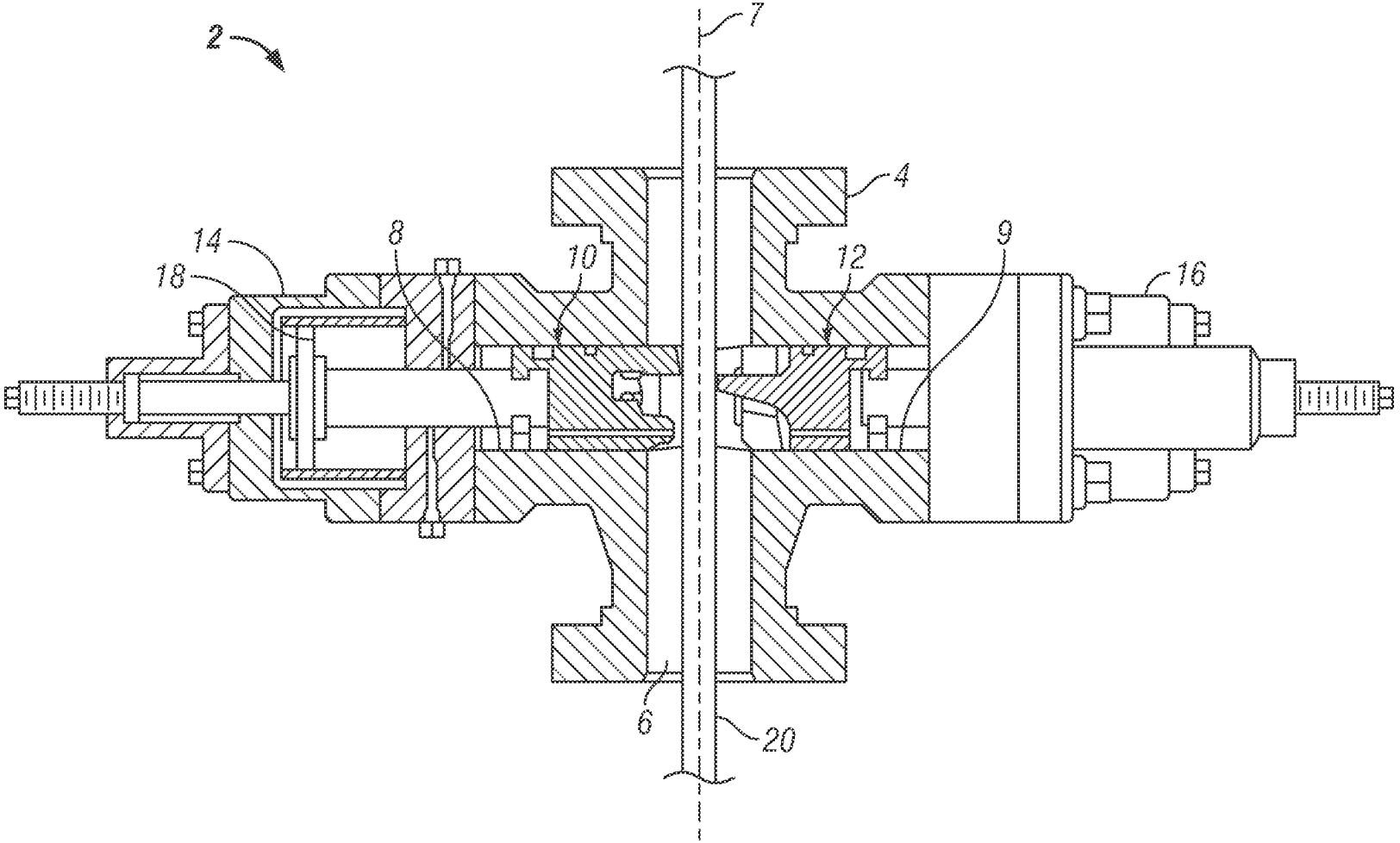
FIG. 1 is a cross-sectional schematic view of a blowout preventer having one or more actuators with rams coupled thereto.

FIG. 1 is a cross-sectional schematic view of a blowout preventer having one or more actuators with rams coupled thereto. The illustrated blowout preventer ("BOP") is a shearing BOP. Other types of BOPs, not illustrated but included herein, are non-shearing and primarily seal across a bore of the well. The BOP 2 includes a blowout preventer body 4 having an opening 6 formed therethrough defining a centerline 7. The opening 6 is sized sufficiently to allow a tubular member 20 to be placed through the opening 6 generally aligned with the centerline 7.

The blowout preventer 2 further includes a first ram 10 disposed laterally to the opening 6. The ram 10 can move laterally left and right in the view of the FIG. 1 and is guided by a first guideway 8. The first guideway 8 is disposed at some non-zero angle to the centerline 7 of the opening 6, generally at a right angle. Similarly, a second ram 12 is disposed in a second guideway 9 at an angle to the centerline 7. The first ram 10 is actuated by a first actuator 14. The first actuator 14 can be electrically, hydraulically, pneumatically, or otherwise operated. In the example shown, an actuator piston 18 is displaced by incoming pressurized fluid to move the first ram 10 toward the centerline 7 to engage and generally sever the tubular member 20 disposed therein. Similarly, the second ram 12 can be actuated by a second actuator 16 to move the second ram 12 toward the centerline 7 to assist in severing the tubular member 20 in conjunction with the first ram 10.

Figure 2:
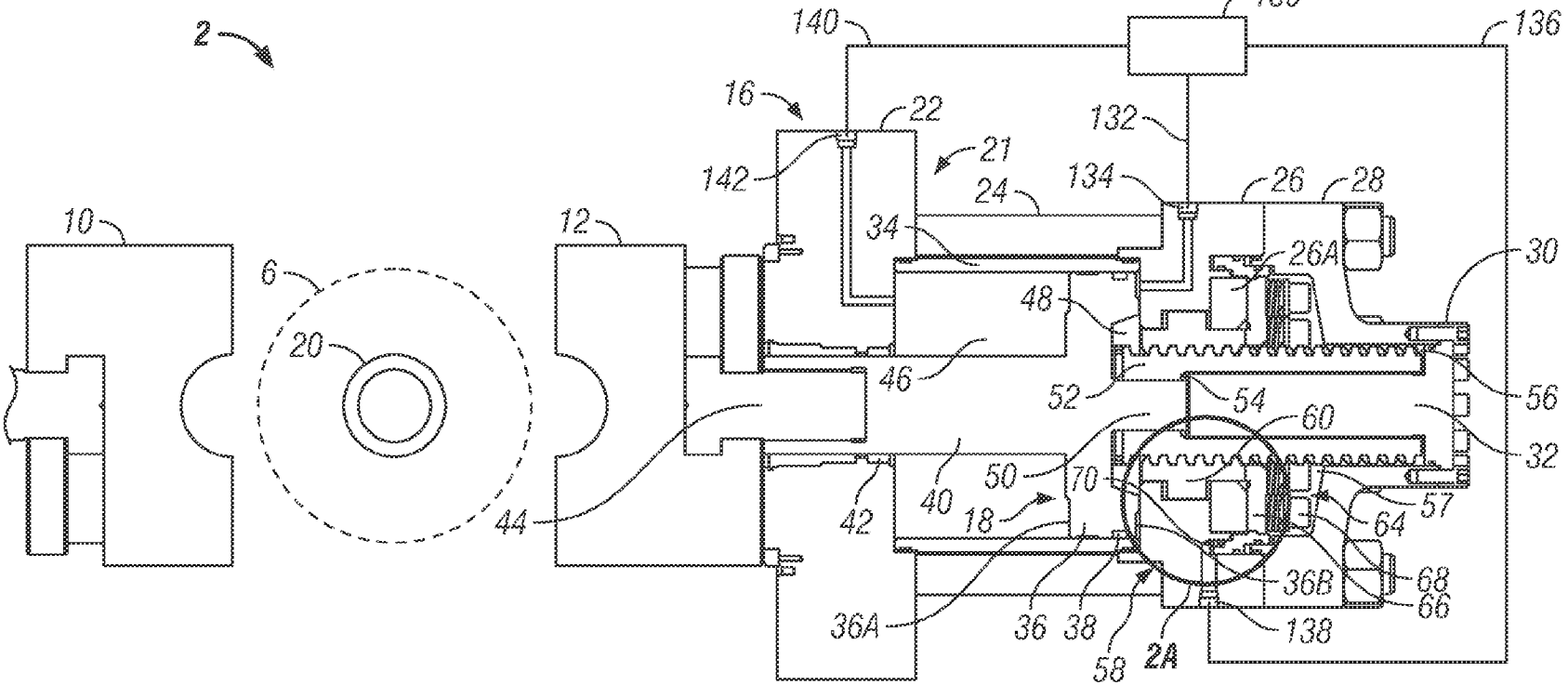
FIG. 2 is a schematic top view of a portion of the BOP in FIG. 1, illustrating features of an actuator, when the BOP is in a locked, open position and without having activation amounts of clutch fluid pressure, closing fluid pressure, or opening fluid pressure.
Figure 2B:
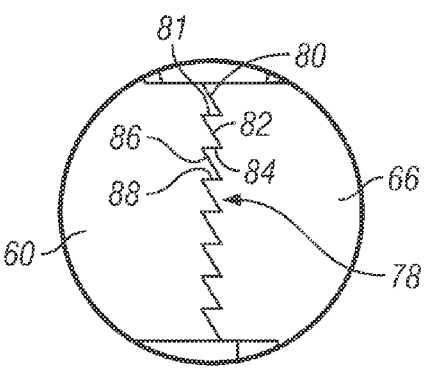
FIG. 2B is a detail schematic view of ratchet teeth in a clutch of the locking system in FIG. 2A.
Figure 2A:
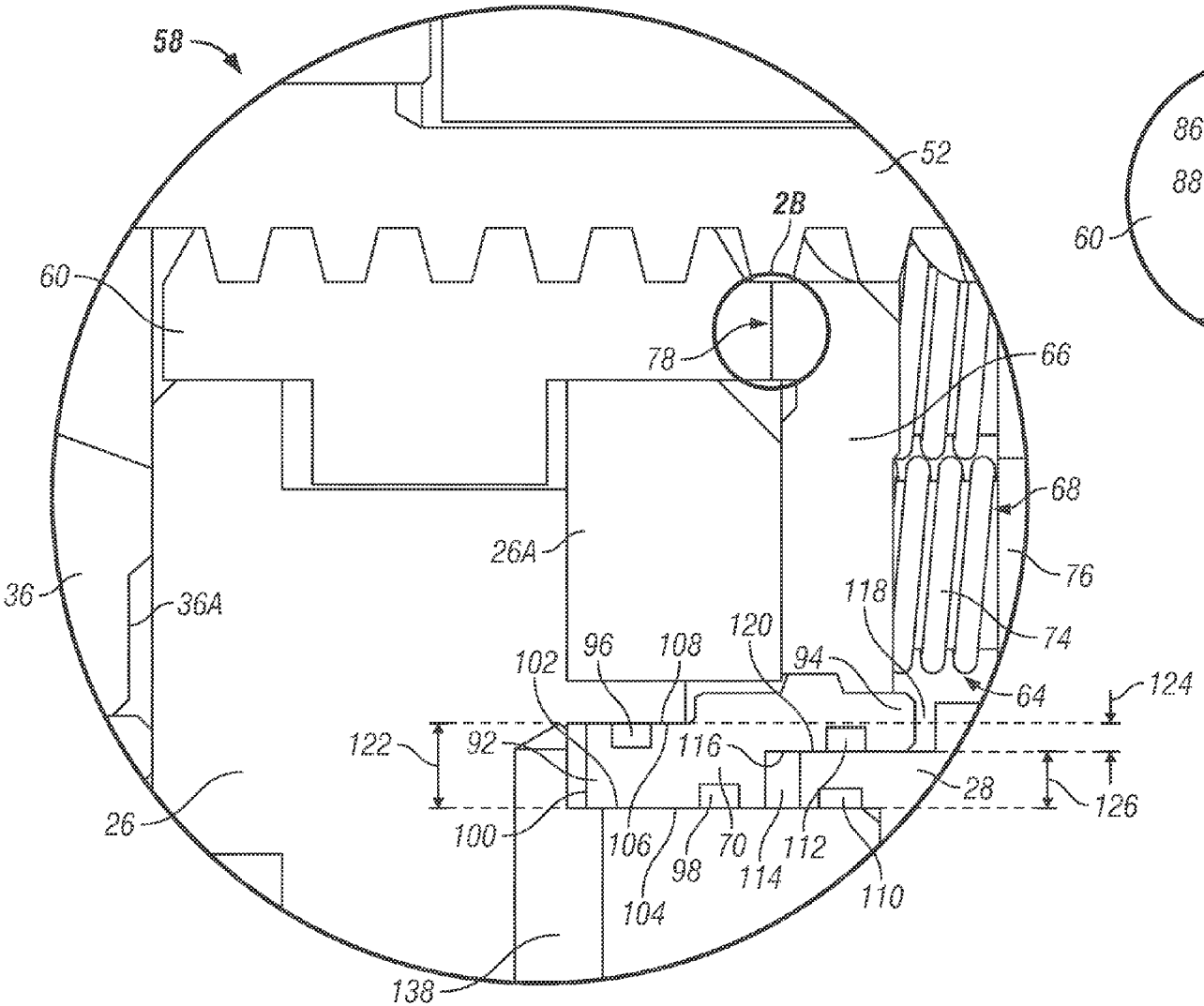
FIG. 2A is a detail schematic view of a locking system of the actuator in FIG. 2.

FIG. 2 is a schematic top view of a portion of the BOP in FIG. 1, illustrating features of an actuator, when the BOP is in a locked, open position and without having activation amounts of clutch fluid pressure, closing fluid pressure, or opening fluid pressure. FIG. 2A is a detail schematic view of a locking system of the actuator in FIG. 2. FIG. 2B is a detail schematic view of ratchet teeth in a clutch of the locking system in FIG. 2A. The figures will be described in conjunction with each other.

As generally described in FIG. 1, the BOP 2 includes the actuator 16 coupled to the ram 12. Although not illustrated in the remaining figures, it is understood that generally the BOP 2 also includes the actuator piston 18 coupled to the ram 10. The actuator 16 can close the BOP by moving the ram 12 toward the tubular member 20 and the opening 6, and can open by retracting the ram 12 away from the opening 6.

Referring again to FIG. 2, the actuator 16 includes an actuator body 21 that forms various chambers capable of being pressurized with fluid to activate internal components described herein. In at least one embodiment, the actuator body 21 includes an actuator head 22 coupled with one or more studs 24 to a locking nut retainer 26 coupled to a clutch housing 28 coupled to an actuator cap 30. An actuator spacer 32 is coupled to the actuator cap 30 and extends inward along a lateral bore of the actuator 16. The actuator spacer 32 can restrict rotation of a shaft 52, described below, and guide movement of the actuator piston and provide a stopping surface to restrict the amount of opening possible with the actuator. A cylinder sleeve 34 is disposed between the actuator head 22 and the locking nut retainer 26, so that fluid pressure inside the cylinder sleeve 34 can be maintained under pressurized conditions.

An actuator piston 18 is disposed within the cylinder sleeve 34 and moves laterally along the actuator to move the ram 12 toward a closed position in an inward direction toward the opening 6 and toward an open position in an outward direction away from the opening 6. The actuator piston 18 includes an actuator piston head 36 having an inward surface 36A disposed toward the opening 6 and an outward surface 36B disposed in the opposite direction toward the actuator cap 30. The inward and outward surfaces 36A, 36B of the actuator piston 18 define areas for opening and closing fluid pressures to act thereon as described herein. A piston head seal 38 seals the actuator piston head 36 to the cylinder sleeve 34. A piston rod 40 is coupled to the actuator piston head 36 and extends inwardly toward the opening 6. The piston rod 40 is sealed as it moves laterally through the actuator head 22 by one of more piston rod seals 42 coupled between the piston rod and the actuator head. A connector 44 (also known as a "button") can connect the piston rod 40 to the ram 12. In at least one embodiment, the connector 44 can be coupled with the ram 12 to allow the ram to be replaced as needed.

An inward chamber 46 is formed between the piston head inward surface 36A and the opposing face of the actuator head 22. The inward chamber 46 can receive opening fluid which is pressurized for opening the BOP by moving the actuator piston head 36 to the right, relative to the orientation illustrated in FIG. 2. A corresponding outward chamber 48 is formed between the piston head outward surface 36B and surfaces inside the locking nut retainer 26, clutch housing 28, and actuator cap 30 to the right of the actuator piston head 36, as illustrated in FIG. 2. The outward chamber 48 can receive closing fluid that is pressurized for closing the BOP by moving the actuator piston head 36 to the left, relative to the orientation illustrated in FIG. 2.

A piston tail shaft 50 can be coupled to the actuator piston head 36 toward the right of the outward surface 36B in the illustration of FIG. 2. The piston tail shaft 50 can be disposed adjacent the actuator spacer 32 when the BOP is in an open position. A tail shaft chamber 54 is formed between the piston tail shaft 50 and the actuator spacer 32. A piston threaded shaft 52 can be coupled around the piston tail shaft 50, so that piston tail shaft 50 can assist in maintaining alignment of the surrounding piston threaded shaft 52. The piston threaded shaft 52 can slidably engage the actuator spacer 32 as the actuator piston 18 moves the ram 12 inwardly and outwardly between closing and opening positions. A threaded shaft chamber 56 is formed between an end of the piston threaded shaft 52 and a portion of the actuator cap 30.

A locking system 58 can be selectively actuated to restrain lateral movement of the piston threaded shaft 52, and thereby restrain lateral movement of the actuator piston 18 and the ram 12 coupled thereto in one or more closed or open positions. In at least one embodiment and without limitation, the locking system 58 can generally include a locking nut 60, a clutch assembly 64, and a clutch piston 70. The locking nut 60 can be restrained from rotation by the clutch assembly 64 which is activated by the clutch piston 70, described in more detail below. A clutch port 138 can provide clutch fluid to the locking system 58 for pressurizing and activating the clutch piston 70. The port 138 can be formed in the locking nut retainer 26 in at least one embodiment.

The locking nut 60 can be an annularly formed nut having internal threads that can interact with external threads on the threaded shaft 52, in at least one embodiment. The locking nut 60 is disposed radially inwardly inside the locking nut retainer 26 and can be retrained from lateral movement between a step on the locking nut retainer and a locking nut retainer ring 26A. The locking nut can rotate clockwise and counter-clockwise depending on whether the piston threaded shaft 52 is opening or closing. The piston threaded shaft 52 generally does not rotate and can be held in position, for example by lateral spines (not shown) formed in the actuator to restrain rotation. Thus, the threaded shaft 52 can move laterally and is restrained from rotation, while the locking nut 60 can rotate and is restrained from moving laterally. The locking nut 60 selectively interfaces with a clutch plate 66 on the clutch assembly 64 at a gripping surface 78 on the clutch plate. In at least one embodiment, the gripping surface 78 on the clutch plate 66 can include ratchet teeth, described below.

As shown more particularly in FIG. 2B, the locking nut 60 can include a set of ratchet teeth that interfaces with a corresponding set of ratchet teeth on the clutch plate 66. The ratchet teeth 80 of the locking nut 60 generally includes an inclined portion 82 and a flat portion 84. Corresponding ratchet teeth 81 on the clutch plate 66 generally includes a corresponding inclined portion 86 and a flat portion 88. When engaged, the ratchet teeth help restrain the lock nut from rotating, which restrains the piston threaded shaft 52 from moving laterally and thus restrains the ram 12 movement, particularly from opening outwardly.

The clutch assembly 64 can include the clutch plate 66 and a clutch bias assembly 68. The clutch bias assembly 60 can include a bias member 74, such as a spring, and a bias member retainer 76, such as nut or other fastener. The bias member 74 assists in biasing the clutch plate 66 toward the locking nut 60. The bias member retainer 76 helps secure the bias member 74 in position. The bias member retainer 76 can also couple the clutch assembly 64 to the locking nut retainer 26 and/or locking nut retainer ring 26A. Thus, in at least one embodiment, the clutch assembly 64 does not rotate, while the locking nut 60 may selectively rotate. A clutch chamber 57 is formed within the actuator body 21 and is generally fluidicly coupled with the outward chamber 48. The clutch assembly 64 can be disposed generally within the clutch chamber 57.

The clutch piston 70 has a first portion 92 and a smaller second portion 94. In at least one embodiment, the clutch piston 70 is an annular piston having a stepped configuration with different diameters. In other embodiments, the clutch piston 70 can be a collection of separate pistons in separate chambers (not shown) disposed radially around the clutch plate 66 and collectively used to activate the clutch plate 66. The first portion 92 of the clutch piston 70 is disposed in a first piston chamber 100 formed in the locking nut retainer 26, in at least one embodiment. The first piston chamber 100 has an outer periphery 102 and an inner periphery 106 and is fluidicly coupled with the clutch port 138. However, the first piston chamber 100 is fluidicly decoupled from the inward chamber 46, so that a clutch fluid pressure can be exerted on the clutch piston 70 independently of an opening fluid pressure on the actuator piston 18. Similarly, the first piston chamber 100 is fluidicly decoupled from the outward chamber 48, so that a clutch fluid pressure can be exerted on the clutch piston 70 independently of a closing fluid pressure on the actuator piston 18. A seal 96 coupled with an inner periphery 108 of the first portion 92 seals against and is slidably engaged with the inner periphery 106 of the first piston chamber 100. A seal 98 coupled with an outer periphery 104 of the first portion 92 seals against and is slidably engaged with an outer periphery 102 of the first piston chamber 100. Thus, a first piston area 122 is formed between the outer periphery 102 and the inner periphery 106 of the first piston chamber 100. The first piston area 122 is a pressure area upon which clutch fluid pressure through the clutch port 138 can act on first portion 92 of the clutch piston 70. A clearance 114 in the first piston chamber 100 is provided for the movement of the first portion 92 of the clutch piston 70.

The second portion 94 of the clutch piston 70 operates within a piston cavity 118 formed radially inwardly from the clutch housing 28 in at least one embodiment. A step on the clutch housing 28 provides for a reduced diameter surface to form an outer periphery 120 of the piston cavity 118. In at least one embodiment, the piston cavity 118 is generally fluidicly coupled with the clutch chamber 57 and the outward chamber 48.

The second portion 94 of the clutch piston 70 is engaged with a sealing surface to form a second piston area as does the first portion 92, but at a different periphery than the outer periphery 102 of the first piston chamber 100. The difference in peripheries provides flexibility in the operation of the BOP, as described below. More specifically, the second portion 94 defines an outer periphery 116 that is smaller than the outer periphery 104 of the first portion 92. A seal 112 coupled with the outer periphery 116 of the second portion 94 seals against and is slidably engaged with the outer periphery 120 of a piston cavity 118 in which the second portion slides. The outer periphery 120, sealed by the seal 112 with the second portion 94 of the clutch piston, defines an outer periphery for a second piston area 124. An inner periphery for the second piston area 124 is defined by the inner periphery 106 of the first piston chamber 100 sealed by the seal 96. Thus, the second piston area 124 is defined by the area between the outer periphery 120 of the piston cavity 118 and the inner periphery 108 of the first piston chamber 100.

As described in more detail below, a differential piston area 126 is defined between piston areas 122, 124. An inner periphery of this differential piston area 126 is defined by the outer periphery 120 of the piston cavity 118. An outer periphery of this differential piston area 126 is defined by the outer periphery 102 of the first piston chamber 100. Thus, the differential piston area 126 can be defined as a difference between the first piston area 122 and the second piston area 124, in at least one embodiment, and can be calculated by the difference in areas between the outer periphery 102 of the first piston chamber 100 and the outer periphery 120 of the piston cavity 118. As described in more detail in the following figures, the differential piston area 126 allows a force created by clutch fluid pressure exerted on the first piston area 122 to overcome a counterforce created by closing fluid pressure exerted on the second piston area 124, even when the closing fluid pressure is exerted at the same time as the clutch fluid pressure, and, in at least some embodiments, even when the pressures are substantially equal from the same pumping system. In general, the differential piston area 126 is sized, so that the force created by clutch fluid pressure on the first piston area 122 can overcome both the force created by the closing fluid pressure on the second piston area 124 and the bias force created by the bias member 74 on the clutch plate 66.

A pumping system 130, generally comprising a pump, a controller, and associated valving, piping, and circuitry (not shown), is illustrated in schematic form to provide pressurized fluid to the various portions of the actuator. In at least one embodiment, the pump provides a single pressure source of fluid that is provided to the controller to selectively provide the pressurized fluid throughout the BOP. For example, the pumping system 130 can provide closing fluid pressure to the actuator piston 18 through a closing fluid line 132 coupled to a closing port 134, clutch fluid pressure to the clutch piston 70 through a clutch fluid line 136 coupled to a clutch port 138, and opening fluid pressure to the actuator piston 18 through an opening fluid line 140 coupled to an opening port 142. The closing port 134 can be fluidicly coupled to the outward chamber 48 to provide fluid pressure to close the BOP and move the ram 12 toward the port opening 6. The opening port 122 can be fluidicly coupled to the inward chamber 46 that can open the ram 12 away from the opening 6 in an outward direction. The clutch port 138 can be coupled to the clutch piston 70 to selectively actuate the clutch plate 66 and control engagement with the locking nut 60.

By selectively controlling when the different chambers receive fluid pressure, the clutch assembly 64 can be activated at different times to reduce the wear, while allowing the system to be fully controlled during the opening and the closing of the BOP. The clutch assembly 64 can be selectively activated to engage and disengage the locking nut 60, even during closing operations of the BOP. Such selection engagement can reduce wear between the locking nut and the clutch plate, in contrast to other systems.

An exemplary sequence of operations for closing and opening the BOP 2 with the actuator 16 using the clutch assembly 64 can be illustrated beginning with FIGS. 2-2B. As shown, the actuator 16 is in a deactivated, open position with the actuator piston head 36 disposed outwardly toward the actuator cap 30 and the ram 12 disposed away from the opening 6 of the BOP 2. The clutch assembly 64 is shown in a locked position, so that the clutch plate 66 is engaged with the locking nut 60. Such engagement restricts at least the outward movement of the piston threaded shaft 52. The engagement between the clutch plate 66 and the locking nut 60 occurs, because the clutch bias assembly 68 with the bias member 74 biases the clutch plate 66 toward the locking nut 60 in the absence of a counterforce caused by fluid pressure on the clutch piston 70. The clutch piston 70 is not activated, because it does not have pressure applied through the clutch port 138 to the first portion 92 of the clutch piston 70.

Figure 3:
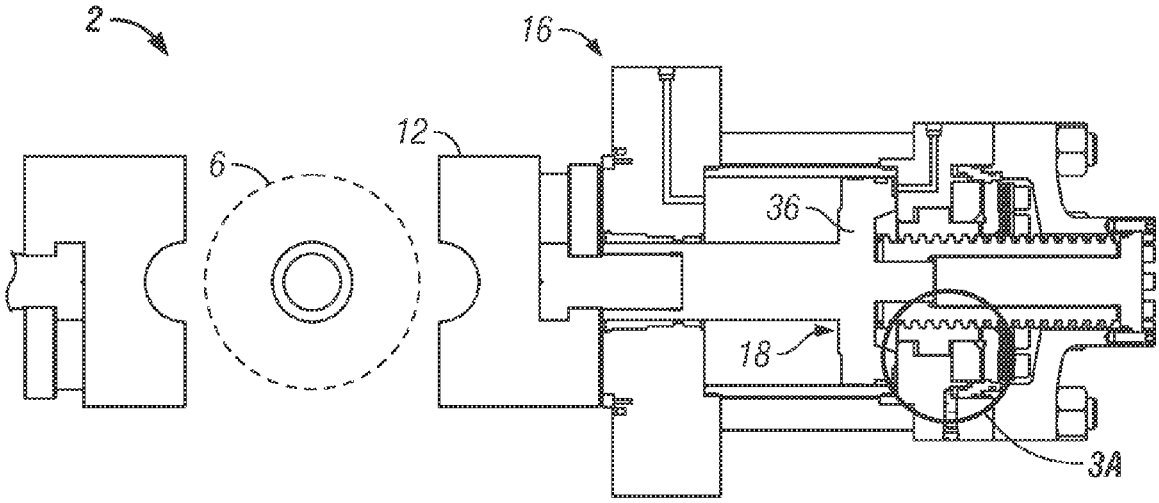
FIG. 3 is a schematic top view of the actuator in FIG. 2, when the BOP is in an unlocked, open position, having a clutch fluid pressure applied to a clutch piston.
Figure 3A:
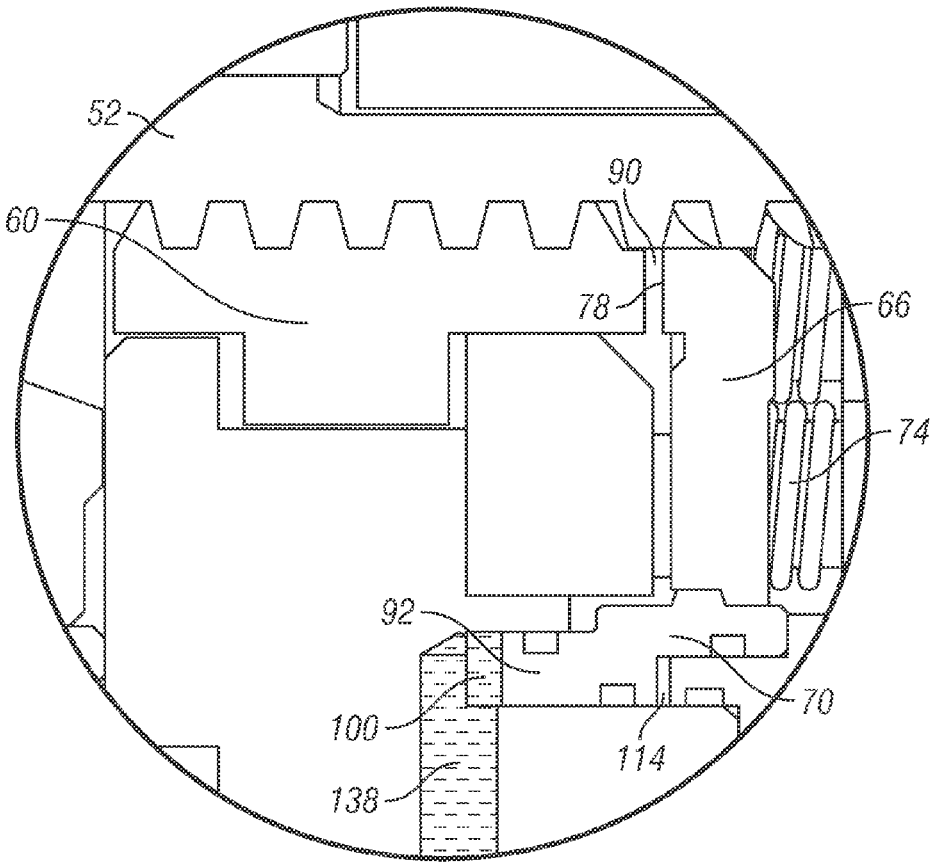
FIG. 3A is a detail schematic view of an unlocked locking system of the actuator in FIG. 3.

FIG. 3 is a schematic top view of the actuator in FIG. 2, when the BOP is in an unlocked, open position, having a clutch fluid pressure applied to a clutch piston. FIG. 3A is a detail schematic view of an unlocked locking system of the actuator in FIG. 3. The figures will be described in conjunction with each other. To actuate the actuator piston 18 with the actuator piston head 36 to a closing position and move the ram 12 toward the opening 6, advantageously clutch fluid pressure is provided through the clutch port 138 to the first portion 92 of the clutch piston 70. The clutch piston 70 is able to move in the first piston chamber 100 using the clearance 114 to force the clutch plate 66 away from the locking nut 60. The disengagement creates a disengagement gap 90 between the gripping surface 78 of the clutch plate 66 and the locking nut 60, so that ratchet teeth, if present, of the clutch plate and the locking nut are cleared from each other in at least one embodiment.

Figure 4:
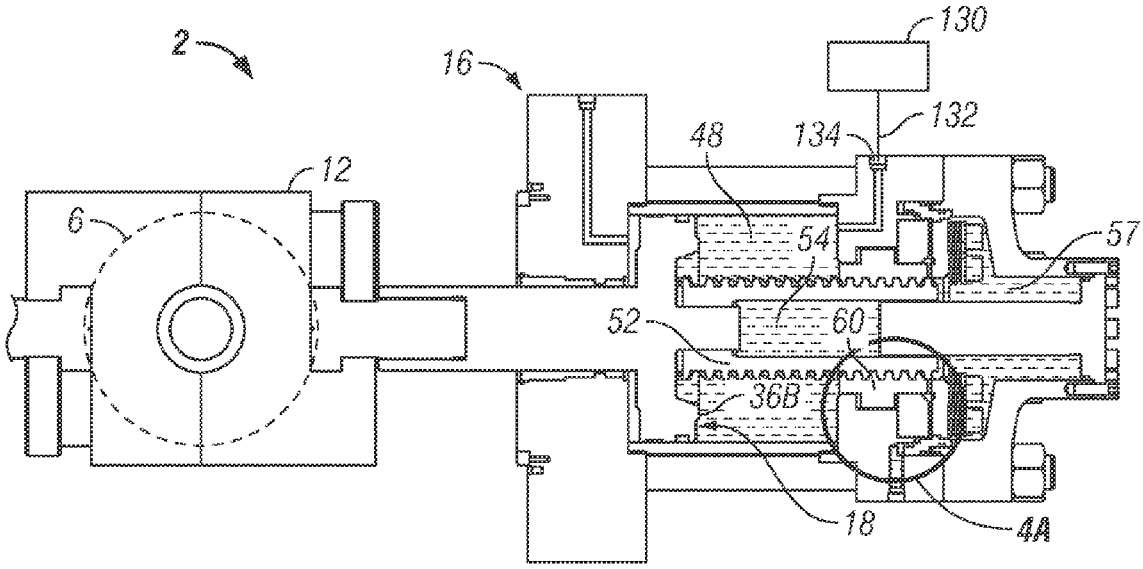
FIG. 4 is a schematic top view of the actuator in FIG. 2, when the BOP is in an unlocked, closed position, having a clutch fluid pressure applied to a clutch piston and closing fluid pressure applied to the actuator piston.
Figure 4A:
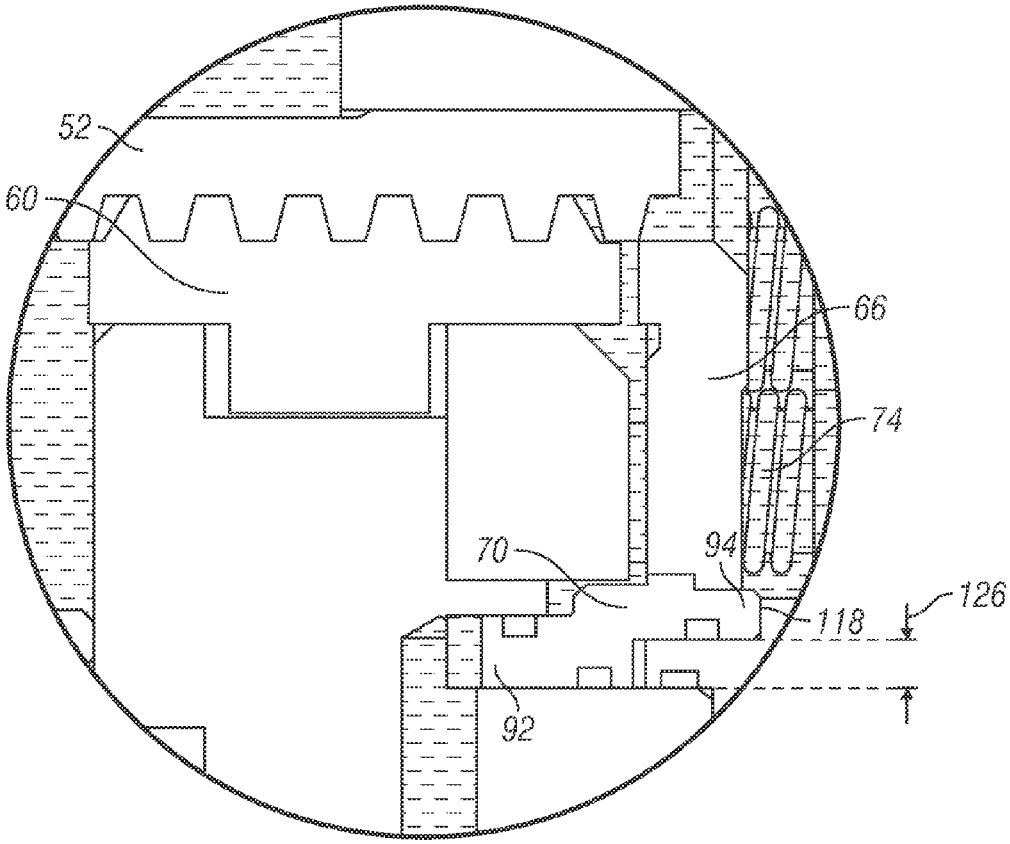
FIG. 4A is a detail schematic view of an unlocked locking system of the actuator in FIG. 4.

FIG. 4 is a schematic top view of the actuator in FIG. 2, when the BOP is in an unlocked, closed position, having a clutch fluid pressure applied to a clutch piston and closing fluid pressure applied to the actuator piston. FIG. 4A is a detail schematic view of an unlocked locking system of the actuator in FIG. 4. The figures will be described in conjunction with each other. The closing fluid pressure can be provided to the actuator 16 by fluid provided through the closing fluid line 132 from the pumping system 130 into the outward chamber 48, and other chambers fluidicly coupled therewith, including the clutch chamber 57. Further, because the piston cavity 118 is fluidicly coupled with the clutch chamber 57, the closing fluid pressure exerts a force on the second portion 94 of the clutch piston 70 to further bias the clutch plate 66 toward the locking nut 60. However, because of the differential pressure area 126, the force exerted by the clutch fluid pressure on the first portion 92 of the clutch piston 70 is generally greater that the force exerted by the closing fluid pressure on the second portion 94 of the clutch piston 70 (and the bias force from the bias member 74), so that the clutch plate 66 can remain disengaged with the locking nut 60.

The closing fluid pressure exerts a closing force on the piston head outward surface 36B of the actuator piston 18 that is coupled to the ram 12. As the piston head moves inwardly from the closing force, the ram 12 moves inwardly toward the opening 6 to close the BOP. As the ram 12 moves inwardly, the piston threaded shaft 52 also moves inwardly, causing the locking nut 60 to rotate due to the threaded engagement between the piston threaded shaft 52 and the locking nut. As the piston threaded shaft 52 moves inwardly and the BOP closes, the clutch plate 66 is disengaged from the locking nut 60 and does not restrain the locking nut from rotating. The closing force created by the closing fluid pressure acting on the piston head outward surface 36B is sufficient to keep the actuator piston 18 from retracting outwardly, while the clutch plate 66 is disengaged from the locking nut 60.

Figure 5:
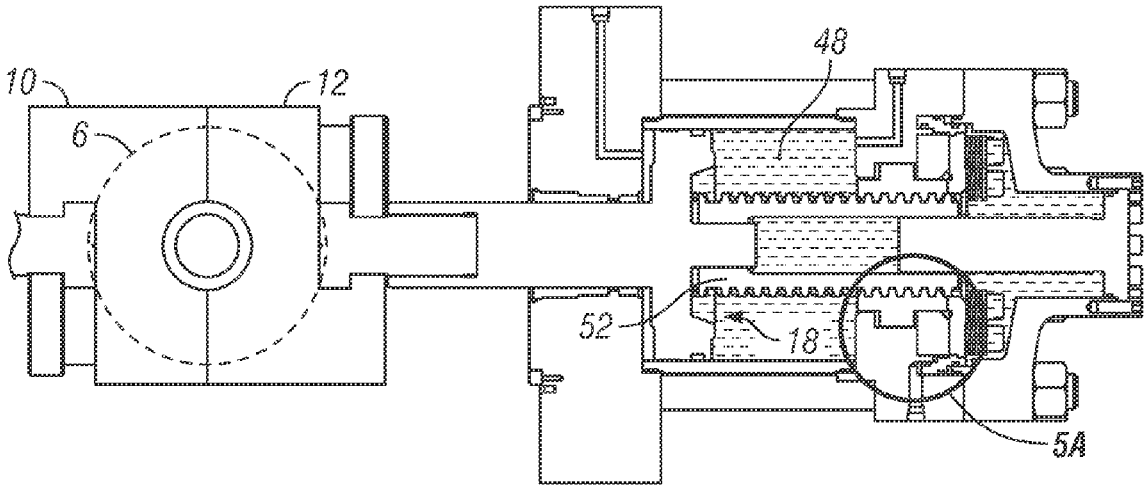
FIG. 5 is a schematic top view of the actuator in FIG. 2, when the BOP is in a locked, closed position, having the clutch fluid pressure reduced and the closing fluid pressure applied to the actuator piston.
Figure 5A:
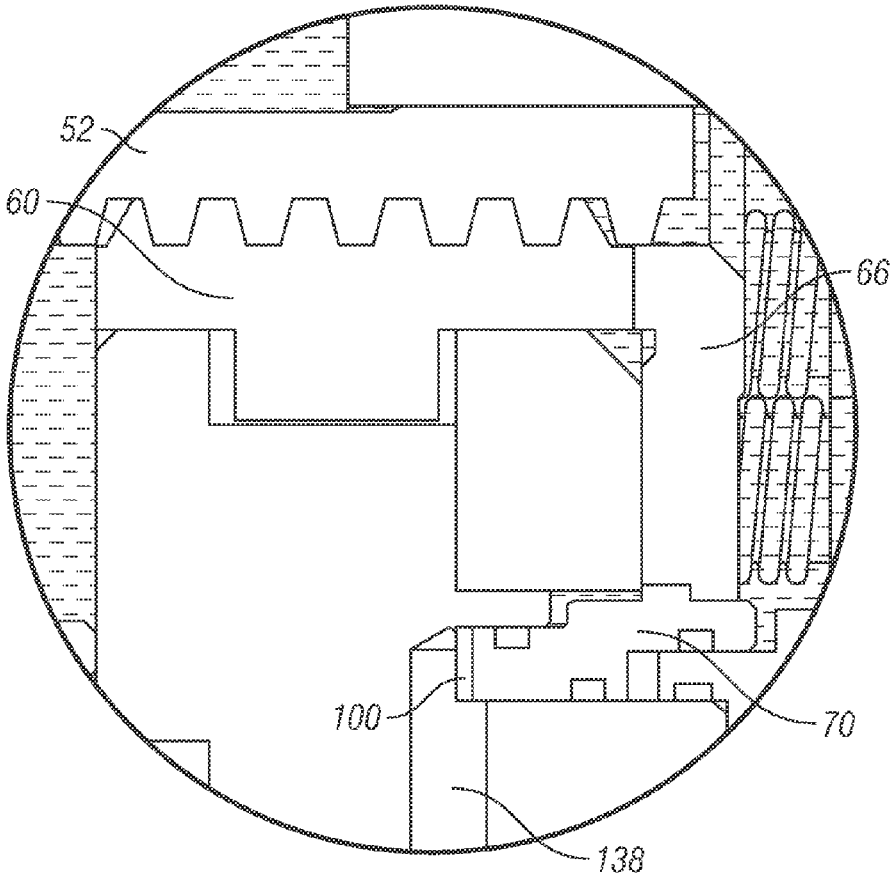
FIG. 5A is a detail schematic view of an unlocked locking system of the actuator in FIG. 5.

FIG. 5 is a schematic top view of the actuator in FIG. 2, when the BOP is in a locked, closed position, having the clutch fluid pressure reduced and the closing fluid pressure applied to the actuator piston. FIG. 5A is a detail schematic view of an unlocked locking system of the actuator in FIG. 5. The figures will be described in conjunction with each other. The clutch fluid pressure provided through the clutch port 138 on the clutch piston 70 can be reduced, generally by venting, to allow the clutch plate 66 to reengage the lock nut 60. In general, the clutch fluid pressure can be reduced when the actuator piston 18 has moved inwardly a sufficient amount, so that the ram 12 has sealingly engaged its counterpart ram 10, also shown in FIG. 1, or some other position determined by the movement of the ram. Because the first piston chamber 100 is fluidicly decoupled from the outward chamber 48, the clutch fluid pressure can be exerted on the clutch piston 70 independently of the closing fluid pressure on the actuator piston 18. The closing fluid pressure in the outward chamber 48 can be maintained until the clutch fluid pressure is reduced and the clutch plate 66 and the locking nut 60 have reengaged. Thus, in at least one embodiment, prior to reducing the closing fluid pressure, the lock nut 60 is restricted from rotation. In such condition, the locking nut 60 restricts the outward movement of the piston threaded shaft 52 and consequently the actuator piston 18 and the ram 12.

Figure 6:
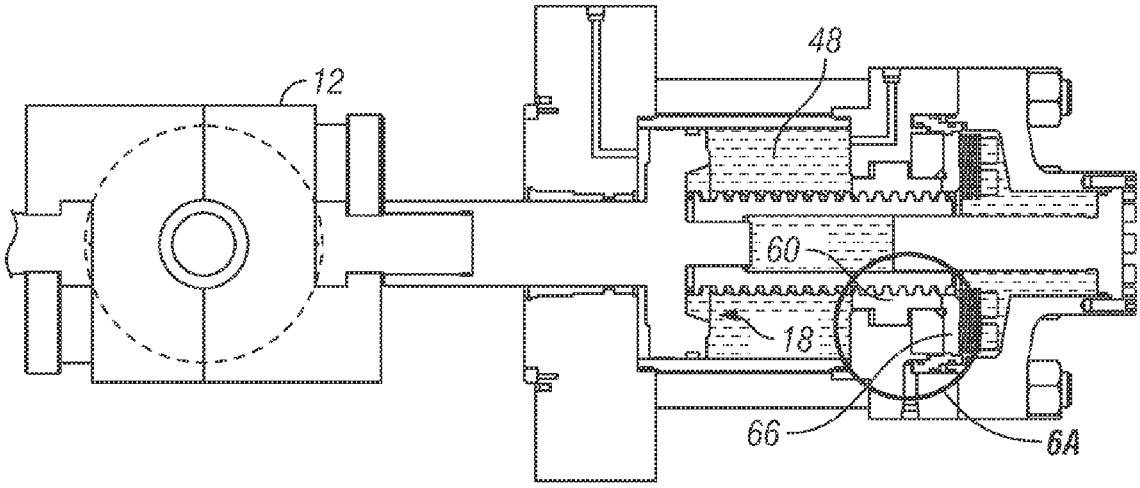
FIG. 6 is a schematic top view of the actuator in FIG. 2, when the BOP is in a locked, closed position, having the clutch fluid pressure reduced and the closing fluid pressure reduced.
Figure 6A:
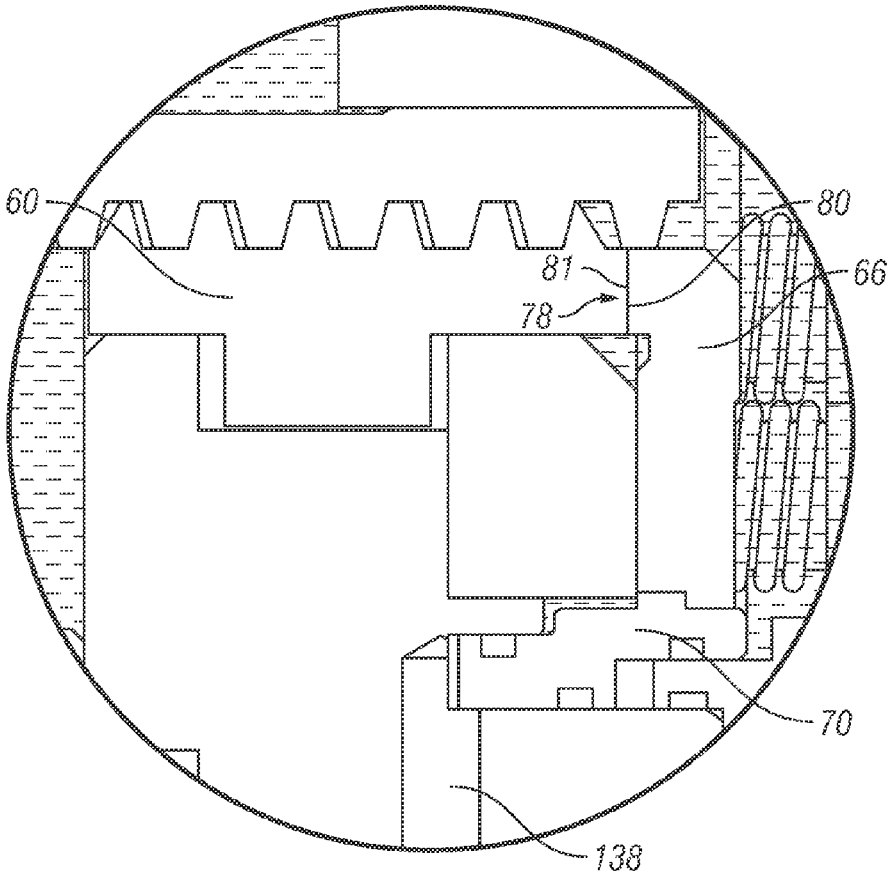
FIG. 6A is a detail schematic view of an unlocked locking system of the actuator in FIG. 6.

FIG. 6 is a schematic top view of the actuator in FIG. 2, when the BOP is in a locked, closed position, having the clutch fluid pressure reduced and the closing fluid pressure reduced. FIG. 6A is a detail schematic view of an unlocked locking system of the actuator in FIG. 6. The figures will be described in conjunction with each other. In at least one embodiment when the clutch plate 66 and locking nut 60 are reengaged, the closing fluid pressure can be reduced from the outward chamber 48. While wellbore pressure from the well to which the BOP is mounted exerts an outwardly directed force to try to push the ram 12 open, the movement of the ram 12 is restricted by the clutch plate 66 engaged with the locking nut 60 that restrains the locking nut from rotation. The gripping surface 78, and accompanying ratchet teeth 80, 81, if present, are thus under a load to restrain the locking nut 60 from rotating. Thus, the BOP is closed and pressure on all chambers can be reduced. However, in contrast to other efforts, the locking nut and the clutch plate were engaged at a time in the closing process when minimal wear would occur therebetween, because the ram had already been moved inwardly to at least to a partially closed position before the engagement between the clutch plate 66 and locking nut 60 occurred in closing.

Figure 7:
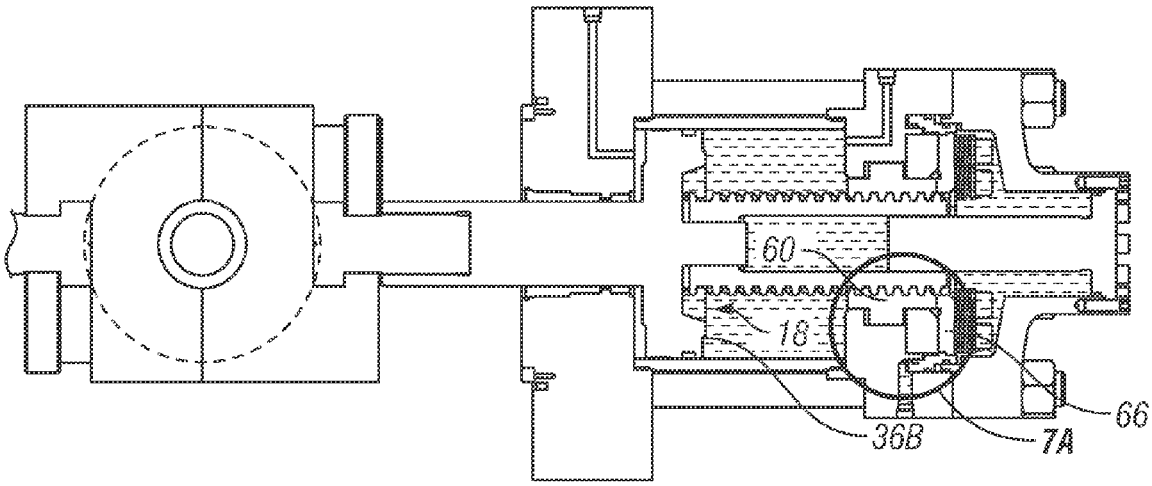
FIG. 7 is a schematic top view of the actuator in FIG. 2, when the BOP is in a locked, closed position, having the clutch fluid pressure reduced and the closing fluid pressure applied to the actuator piston.
Figure 7A:
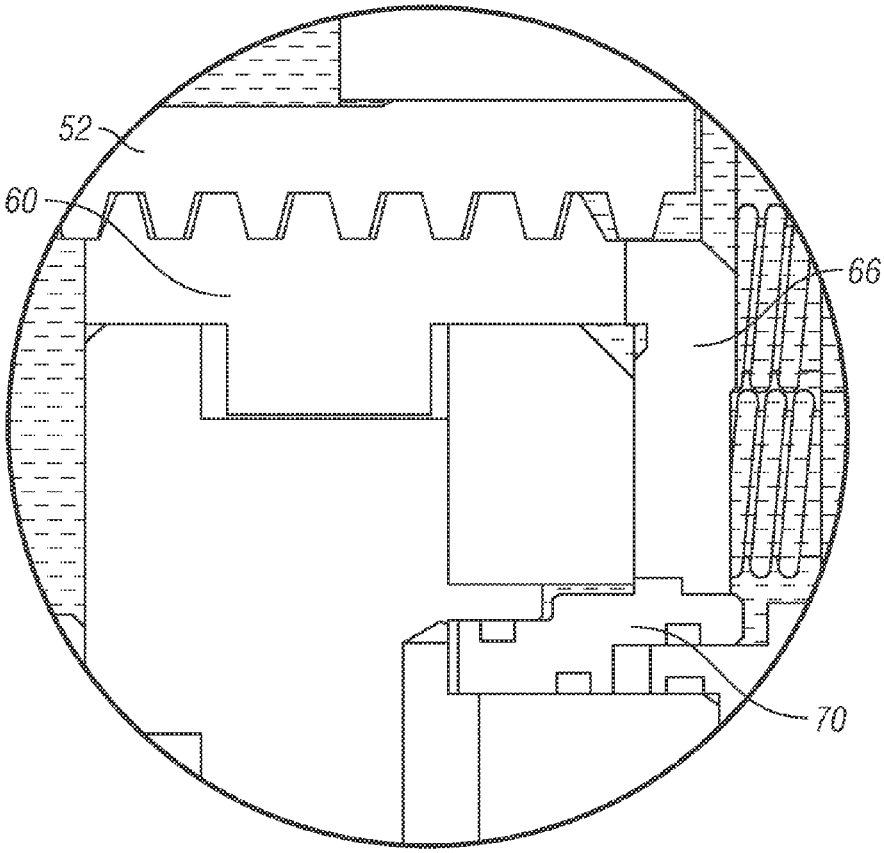
FIG. 7A is a detail schematic view of an unlocked locking system of the actuator in FIG. 7.

FIG. 7 is a schematic top view of the actuator in FIG. 2, when the BOP is in a locked, closed position, having the clutch fluid pressure reduced and the closing fluid pressure applied to the actuator piston. FIG. 7A is a detail schematic view of an unlocked locking system of the actuator in FIG. 7. The figures will be described in conjunction with each other. To open the BOP and release the locking nut 60 from engagement with the clutch plate 66, a closing fluid pressure can be applied again to the actuator piston head outer surface 36B. When applied, the closing pressure forces the actuator piston 18 inwardly and relieves the load between the locking nut 60 and the clutch plate 66.

Figure 8:
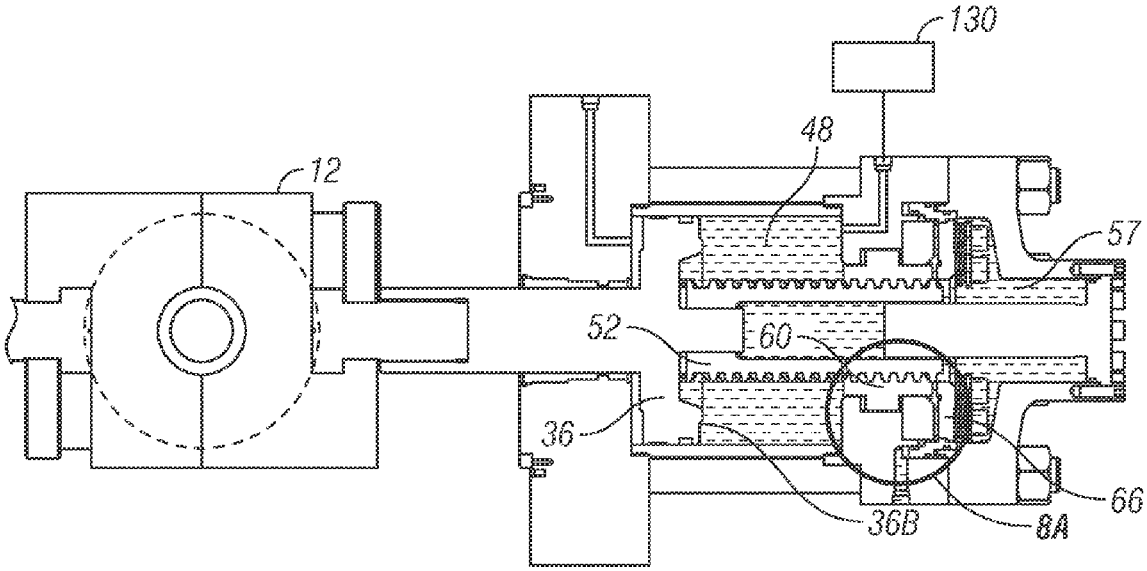
FIG. 8 is a schematic top view of the actuator in FIG. 2, when the BOP is in an unlocked, closed position, having the clutch fluid pressure applied to the clutch piston and the closing fluid pressure applied to the actuator piston.
Figure 8A:
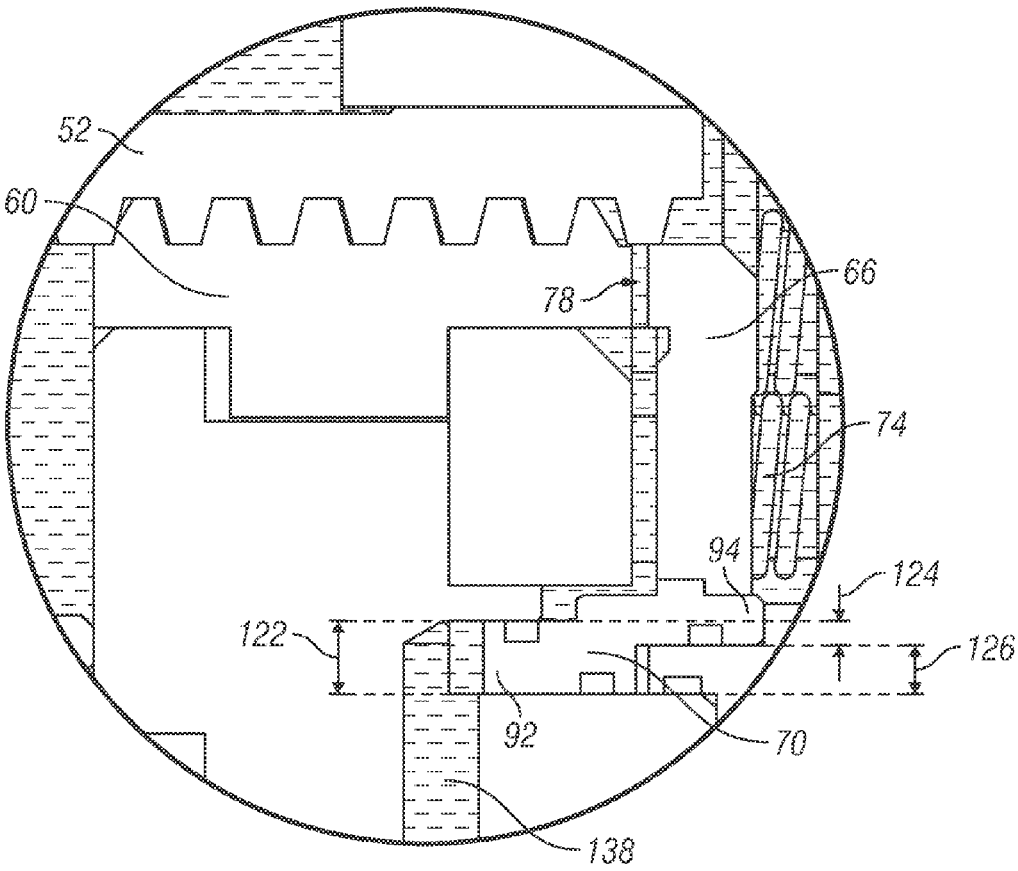
FIG. 8A is a detail schematic view of an unlocked locking system of the actuator in FIG. 8.

FIG. 8 is a schematic top view of the actuator in FIG. 2, when the BOP is in an unlocked, closed position, having the clutch fluid pressure applied to the clutch piston and the closing fluid pressure applied to the actuator piston. FIG. 8A is a detail schematic view of an unlocked locking system of the actuator in FIG. 8. The figures will be described in conjunction with each other. Clutch fluid pressure through the clutch port 138 can be applied to the first portion 92 of the clutch piston 70, while the closing fluid pressure is applied to the piston head outward surface 36B to disengage the clutch plate 66 from the locking nut 60. The clutch plate 66 is disengaged from the locking nut 60, when the clutch plate and locking nut engagement are under little or no load from any outward force caused by wellbore pressure on the ram 12. The closing fluid pressure in the chamber 48 can exert force on the actuator piston head 36, so that the gripping surface 78 of the clutch plate is not needed to restrain movement of ram, and forces transmitted through the piston threaded shaft 52 to the locking nut 60. The piston areas 122, 124, 126 on the clutch piston 70 are advantageously used by the system to overcome respective forces exerted on the clutch plate 66. More particularly, the clutch fluid pressure is exerted on the first piston area 122. The closing fluid pressure is exerted on the second piston area 124. The difference between the first piston area 122 and second piston area 124 can define a differential piston area 126. In at least one embodiment, the closing fluid pressure from the same pumping system 130 can be substantially equal to the clutch fluid pressure in the clutch port 138. However, the clutch piston 70 can still be activated and moved to disengage the clutch plate 70, because of the differential piston area 126 between the first piston area 122 and the second piston area 124 on the clutch piston 70, even when there is an opposing closing fluid pressure on the second piston area 124 in the chamber 57.

Figure 9:
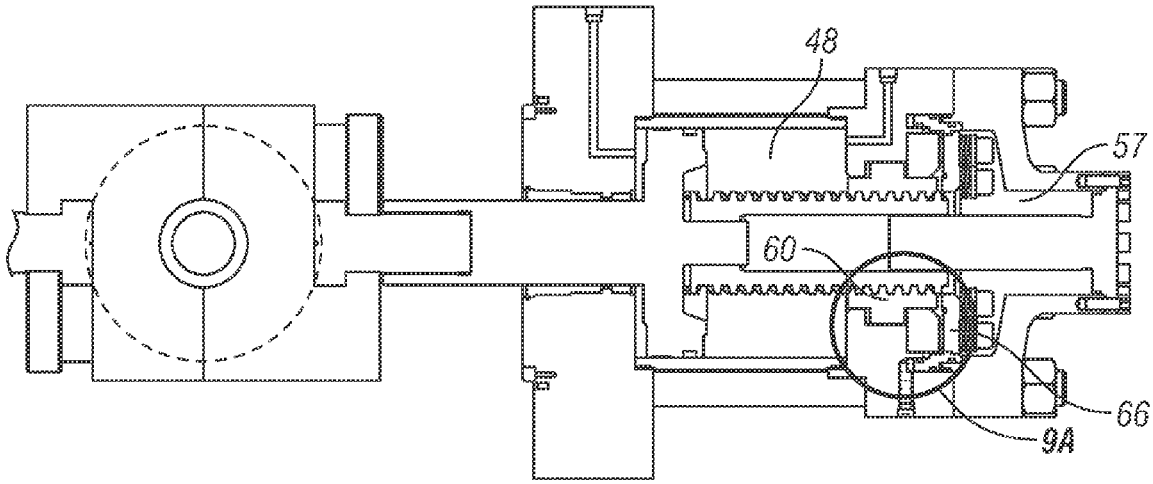
FIG. 9 is a schematic top view of the actuator in FIG. 2, when the BOP is in an unlocked, closed position, having the clutch fluid pressure applied to the clutch piston and the closing fluid pressure reduced.
Figure 9A:
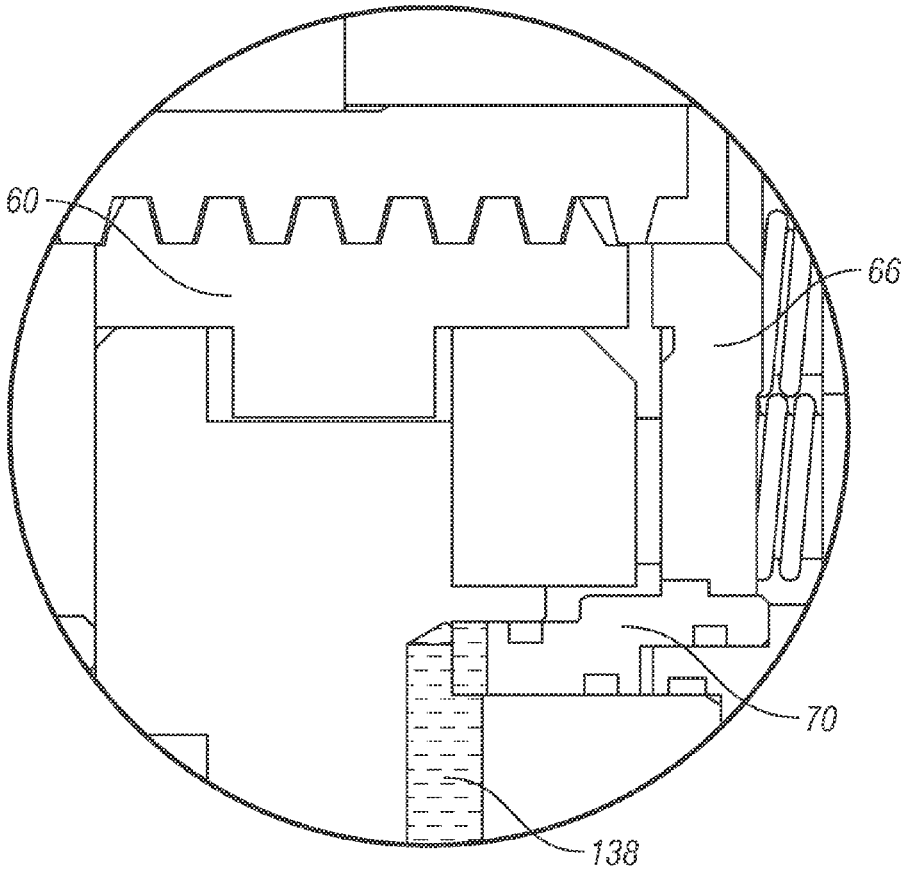
FIG. 9A is a detail schematic view of an unlocked locking system of the actuator in FIG. 9.

FIG. 9 is a schematic top view of the actuator in FIG. 2, when the BOP is in an unlocked, closed position, having the clutch fluid pressure applied to the clutch piston and the closing fluid pressure reduced. FIG. 9A is a detail schematic view of an unlocked locking system of the actuator in FIG. 9. The figures will be described in conjunction with each other. Clutch fluid pressure in the clutch port 138 can be maintained on the clutch piston 70, so that the clutch plate 66 is disengaged from the locking nut 60. The closing fluid pressure can be reduced from the chamber 48, and the other chambers which are fluidicly coupled thereto, including the clutch chamber 57.

Figure 10:
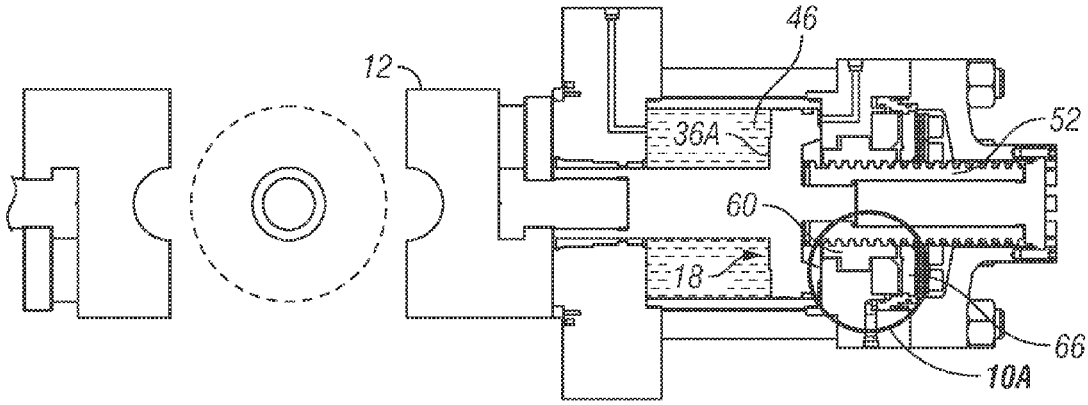
FIG. 10 is a schematic top view of the actuator in FIG. 2, when the BOP is in an unlocked, open position, having the clutch fluid pressure applied to the clutch piston and an opening fluid pressure applied to the actuator piston on a reverse side of the actuator piston from the prior closing fluid pressure.
Figure 10A:
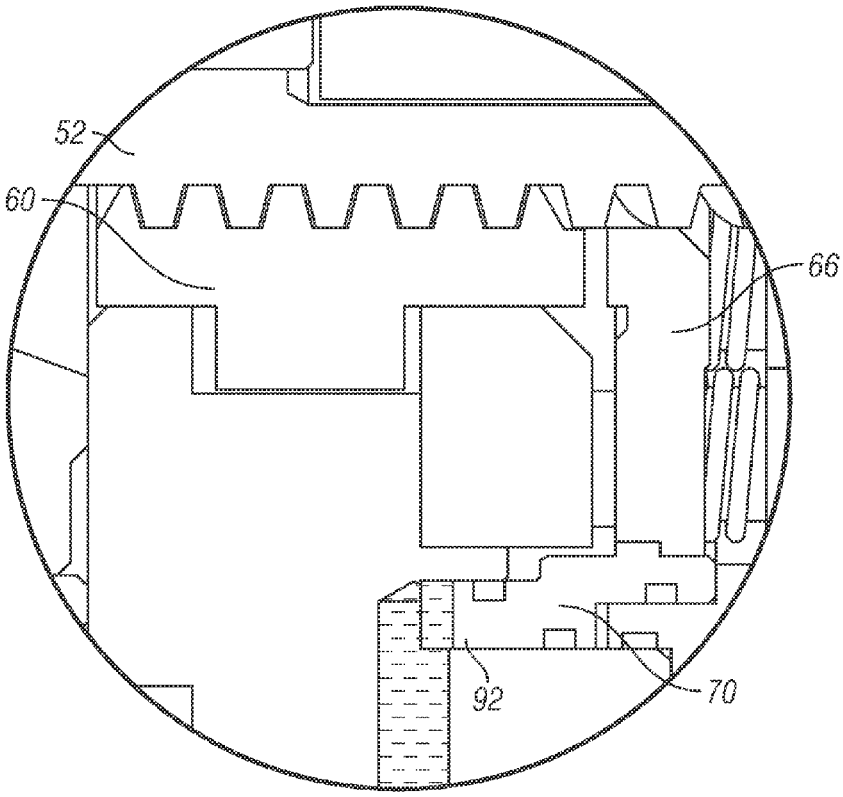
FIG. 10A is a detail schematic view of an unlocked locking system of the actuator in FIG. 10.

FIG. 10 is a schematic top view of the actuator in FIG. 2, when the BOP is in an unlocked, open position, having the clutch fluid pressure applied to the clutch piston and an opening fluid pressure applied to the actuator piston on a reverse side of the actuator piston from the prior closing fluid pressure. FIG. 10A is a detail schematic view of an unlocked locking system of the actuator in FIG. 10. The figures will be described in conjunction with each other. While the clutch fluid pressure is exerted on the first portion 92 of the clutch piston 70, an opening fluid pressure can be applied to the chamber 46 and against the piston head inward surface 36A to move the actuator piston 18 outwardly and open the BOP. Such disengagement allows the locking nut 66 to rotate to allow the threaded shaft 52 to move laterally, resulting in the actuator piston 18 and ram 12 moving outwardly. Advantageously, the opening force can be applied when the clutch plate 66 is already disengaged from the locking nut 60. Such prior disengagement helps reduce the wear between the clutch plate 66 and the locking nut 60. After the BOP has been opened and the actuator piston head 36 retracted to an outward position, the clutch fluid pressure can be reduced. Thus, the BOP can be returned to the state illustrated in FIGS. 2-2B.

Other and further embodiments utilizing one or more aspects of the inventions described above can be devised without departing from the spirit of the disclosed invention. For example and without limitation, the sleeves and chambers, and components engaged therewith, such pistons and clutch plates can be round or other geometric shapes, so that the use of the term "periphery" is to be construed broadly to mean an inner or outer periphery, as the case may be, that may or may not be round. Further, the various methods and embodiments of the system can be included in combination with each other to produce variations of the disclosed methods and embodiments. Discussion of singular elements can include plural elements and vice-versa. References to at least one item followed by a reference to the item may include one or more items. Also, various aspects of the embodiments could be used in conjunction with each other to accomplish the understood goals of the disclosure. Unless the context requires otherwise, the word "comprise" or variations such as "comprises" or "comprising," should be understood to imply the inclusion of at least the stated element or step or group of elements or steps or equivalents thereof, and not the exclusion of a greater numerical quantity or any other element or step or group of elements or steps or equivalents thereof. The device or system may be used in a number of directions and orientations. The term "coupled," "coupling," "coupler," and like terms are used broadly herein and may include any method or device for securing, binding, bonding, fastening, attaching, joining, inserting therein, forming thereon or therein, communicating, or otherwise associating, for example, mechanically, magnetically, electrically, chemically, operably, directly or indirectly with intermediate elements, one or more pieces of members together and may further include without limitation integrally forming one functional member with another in a unity fashion. The coupling may occur in any direction, including rotationally.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicant, but rather, in conformity with the patent laws, Applicant intends to protect fully all such modifications and improvements that come within the scope or range of equivalent of the following claims.

What is claimed is:

1. A blowout preventer for an oil or gas well, comprising:

a blowout preventer body having an opening disposed therethrough for a tubular product to be inserted through the opening and having at least a first guideway formed at an angle to a centerline of the opening;

a first ram slidably coupled to the blowout preventer body along the first guideway formed in the body; and a first actuator coupled to the first ram and adapted to move the first ram along the first guideway in a lateral direction between an open position and a closed position, the first actuator comprising:

an actuator body having a sleeve disposed at an angle to a centerline of the opening sleeve formed therein;

an actuator piston having an actuator piston head slidably disposed at least partially within the sleeve and sealingly engaged with the sleeve, a first end of the actuator piston being coupled to the first ram, and a second end of the actuator piston being coupled to a threaded shaft having threads formed on the shaft; the actuator piston head dividing the sleeve into an inward chamber within the sleeve in a direction toward the centerline of the opening and an outward chamber within the sleeve in a direction away from the centerline of the opening;

a locking nut rotatable relative to the actuator body, the locking nut having corresponding threads adapted to engage the threads on the threaded shaft of the actuator piston and adapted to allow the threaded shaft to move laterally with the actuator piston head as the locking nut rotates relative to the threaded shaft; and a clutch assembly rotationally fixed relative to the actuator body during inward and outward movement of the ram and selectively coupled with the locking nut and adapted to restrain rotation of the locking nut, the clutch assembly comprising:

a clutch plate having a gripping surface disposed toward the locking nut;

a bias assembly comprising a bias member and a bias member retainer coupled to the bias member, the bias assembly adapted to bias the clutch plate toward the locking nut; and a clutch piston slidably coupled with the actuator body and adapted to selectively engage the clutch plate with the locking nut, the clutch piston having a first portion with a first pressure area and a second portion with a second pressure area, a difference between the first pressure area and the second pressure area forming a differential pressure area, the first pressure area being sealed from the second pressure area, the first pressure area being fluidicly coupled to a port to provide fluid pressure to the first pressure area independent of fluid pressure on the second pressure area.

2. The blowout preventer of claim 1, wherein the threads on the threaded shaft comprises external threads and the threads on the locking nut comprises internal threads.

3. The blowout preventer of claim 1, wherein the locking nut is laterally fixed relative to the actuator body.

4. The blowout preventer of claim 1, wherein the clutch assembly is rotationally fixed relative to the actuator body.

5. The blowout preventer of claim 1, wherein the clutch piston comprises an annularly shaped piston.

6. The blowout preventer of claim 1, wherein the second portion of the clutch piston is fluidicly coupled to the outward chamber.

7. The blowout preventer of claim 1, wherein the first portion of the clutch piston is fluidicly decoupled from the inward chamber.

8. The blowout preventer of claim 1, further comprising a second ram and a second actuator coupled to the second ram, the second ram being disposed distal from the first ram relative to the centerline of the opening.

9. The blowout preventer of claim 1, further comprising a pumping system coupled to the actuator.

10. The blowout preventer of claim 1, further comprising a closing fluid line coupled between the pumping system and a closing port on the actuator, an opening fluid line coupled between the pumping system and an opening port on the actuator, and a clutch piston line coupled between the pumping system and a clutch piston port on the actuator.

11. The blowout preventer of claim 1, wherein the gripping surface is configured for gripping the locking nut.

12. The blowout preventer of claim 1, wherein the gripping surface comprises ratchet teeth and wherein a portion of the locking nut disposed toward the gripping surface of the clutch plate comprises corresponding ratchet teeth.

13. The blowout preventer of claim 12, wherein the ratchet teeth allows rotation one direction and restrains rotation in an opposite direction.

14. A blowout preventer for an oil or gas well, comprising:

a blowout preventer body having an opening disposed therethrough for a tubular product to be inserted through the opening and having at least a first guideway formed at an angle to a centerline of the opening;

a first ram slidably coupled to the blowout preventer body along the first guideway formed in the body; and a first actuator coupled to the first ram and adapted to move the first ram along the first guideway in a lateral direction between an open position and a closed position, the first actuator comprising:

an actuator body having a sleeve disposed at an angle to a centerline of the opening sleeve formed therein:

an actuator piston having an actuator piston head slidably disposed at least partially within the sleeve and sealingly engaged with the sleeve, a first end of the actuator piston being coupled to the first ram, and a second end of the actuator piston being coupled to a threaded shaft having threads formed on the shaft; the actuator piston head dividing the sleeve into an inward chamber within the sleeve in a direction toward the centerline of the opening and an outward chamber within the sleeve in a direction away from the centerline of the opening;

a locking nut rotatable relative to the actuator body, the locking nut having corresponding threads adapted to engage the threads on the threaded shaft of the actuator piston and adapted to allow the threaded shaft to move laterally with the actuator piston head as the locking nut rotates relative to the threaded shaft; and a clutch assembly selectively coupled with the locking nut and adapted to restrain rotation of the locking nut, the clutch assembly comprising:

a clutch plate having a gripping surface disposed toward the locking nut:

a bias assembly comprising a bias member and a bias member retainer coupled to the bias member, the bias assembly adapted to bias the clutch plate toward the locking nut; and a clutch piston slidably coupled with the actuator body and adapted to selectively engage the clutch plate with the locking nut, the clutch piston having a first portion with a first pressure area and a second portion with a second pressure area, a difference between the first pressure area and the second pressure area forming a differential pressure area, the first pressure area being sealed from the second pressure area, the first pressure area being fluidicly coupled to a port to provide fluid pressure to the first pressure area independent of fluid pressure on the second pressure area, wherein the differential pressure area is at least large enough to overcome the bias from the bias assembly on the clutch plate when fluid pressure exerted on the first pressure area is equal to fluid pressure exerted on the second pressure area.

15. A blowout preventer or an oil or gas well, comprising:

a blowout preventer body having an opening disposed therethrough for a tubular product to be inserted through the opening and having at least a first guideway formed at an angle to a centerline of the opening;

a first ram slidably coupled to the blowout preventer body along the first guideway formed in the body; and a first actuator coupled to the first ram and adapted to move the first ram along the first guideway in a lateral direction between an open position and a closed position, the first actuator comprising:

an actuator body having a sleeve disposed at an angle to a centerline of the opening sleeve formed therein;

an actuator piston having an actuator piston head slidably disposed at least partially within the sleeve and sealingly engaged with the sleeve, a first end of the actuator piston being coupled to the first ram, and a second end of the actuator piston being coupled to a threaded shaft having threads formed on the shaft; the actuator piston head dividing the sleeve into an inward chamber within the sleeve in a direction toward the centerline of the opening and an outward chamber within the sleeve in a direction away from the centerline of the opening;

a locking nut rotatable relative to the actuator body, the locking nut having corresponding threads adapted to engage the threads on the threaded shaft of the actuator piston and adapted to allow the threaded shaft to move laterally with the actuator piston head as the locking nut rotates relative to the threaded shaft; and a clutch assembly selectively coupled with the locking nut and adapted to restrain rotation of the locking nut, the clutch assembly comprising:

a clutch plate having a gripping surface disposed toward the locking nut:

a bias assembly comprising a bias member and a bias member retainer coupled to the bias member, the bias assembly adapted to bias the clutch plate toward the locking nut; and a clutch piston slidably coupled with the actuator body and adapted to selectively engage the clutch plate with the locking nut, the clutch piston having a first portion with a first pressure area and a second portion with a second pressure area, a difference between the first pressure area and the second pressure area forming a differential pressure area, the first pressure area being sealed from the second pressure area, the first pressure area being fluidicly coupled to a port to provide fluid pressure to the first pressure area independent of fluid pressure on the second pressure area, wherein the actuator piston is rotationally fixed relative to the actuator body.

16. A blowout preventer for an oil or gas well, comprising:

a blowout preventer body having an opening disposed therethrough for a tubular product to be inserted through the opening and having at least a first guideway formed at an angle to a centerline of the opening;

a first ram slidably coupled to the blowout preventer body along the first guideway formed in the body; and a first actuator coupled to the first ram and adapted to move the first ram along the first guideway in a lateral direction between an open position and a closed position, the first actuator comprising:

an actuator body having a sleeve disposed at an angle to a centerline of the opening sleeve formed therein;

an actuator piston having an actuator piston head slidably disposed at least partially within the sleeve and sealingly engaged with the sleeve, a first end of the actuator piston being coupled to the first ram, and a second end of the actuator piston being coupled to a threaded shaft having threads formed on the shaft; the actuator piston head dividing the sleeve into an inward chamber within the sleeve in a direction toward the centerline of the opening and an outward chamber within the sleeve in a direction away from the centerline of the opening;

a locking nut rotatable relative to the actuator body, the locking nut having corresponding threads adapted to engage the threads on the threaded shaft of the actuator piston and adapted to allow the threaded shaft to move laterally with the actuator piston head as the locking nut rotates relative to the threaded shaft; and a clutch assembly selectively coupled with the locking nut and adapted to restrain rotation of the locking nut, the clutch assembly comprising:

a clutch plate having a gripping surface disposed toward the locking nut;

a bias assembly comprising a bias member and a bias member retainer coupled to the bias member, the bias assembly adapted to bias the clutch plate toward the locking nut; and a clutch piston slidably coupled with the actuator body and adapted to selectively engage the clutch plate with the locking nut, the clutch piston having a first portion with a first pressure area and a second portion with a second pressure area, a difference between the first pressure area and the second pressure area forming a differential pressure area, the first pressure area being sealed from the second pressure area, the first pressure area being fluidicly coupled to a port to provide fluid pressure to the first pressure area independent of fluid pressure on the second pressure area, wherein the first portion of clutch piston defines an outer diameter larger than an outer diameter of the second portion of the clutch piston.

17. A method of actuating a blowout preventer for an oil or gas well, the blowout preventer comprising a blowout preventer body having an opening for inserting a tubular product therethrough, at least one ram slidably coupled to the blowout preventer body, a first actuator adapted to move the ram between an open position and a closed position; the actuator having an actuator body with an actuator piston disposed therein, the actuator piston having an actuator piston head dividing an internal portion of the actuator body into an inward chamber in a direction toward the opening from the actuator piston head and an outward chamber in a direction away from the opening from the actuator piston head, the actuator piston further having a threaded portion adapted to engage a threaded locking nut rotatable relative to the actuator body, the actuator further having a clutch assembly having a clutch plate selectively coupled with the locking nut, and a locking piston having a first portion with a first pressure area and a second portion with a second pressure area, a difference between the first pressure area and the second pressure area forming a differential pressure area, the first pressure area being sealed from the second pressure area, the method, starting from an open position, comprising:

applying a clutch fluid pressure to the first portion of the clutch piston to move the clutch piston;

disengaging the clutch plate from the locking nut with the clutch piston;

applying a closing fluid pressure to the actuator piston from the outward chamber while the clutch plate is disengaged from the locking nut;

moving the ram inward toward the opening to at least partially close the blowout preventer; and reducing the clutch fluid pressure to the first portion of the clutch piston to allow the clutch plate to engage the locking nut and maintain the ram in an at least partially closed position.

18. The method of claim 17, further comprising:

reducing the closing fluid pressure to the actuator piston when the clutch plate is engaged with the locking nut.

19. The method of claim 17, wherein applying the closing fluid pressure further comprises applying the closing fluid pressure to the second pressure area of the second portion of the clutch piston which has less force on the clutch piston than a force from the clutch fluid pressure on the first portion of the clutch piston.

20. The method of claim 19, wherein the less force on the second portion of the clutch piston is due to the differential pressure area when the closing fluid pressure and clutch fluid pressure are the same pressure.

21. The method of claim 17, further comprising opening the blowout preventer comprising:

applying an opening fluid pressure to the actuator piston from the outward chamber while the clutch plate is engaged with the locking nut;

applying a clutch fluid pressure to the first portion of the clutch piston.

disengaging the clutch plate from the locking nut;

reducing the closing fluid pressure in the outward chamber; and applying an opening fluid pressure to the actuator piston from the inward chamber while the clutch plate is disengaged from the locking nut to at least partially open the blowout preventer.

22. The method of claim 21, further comprising:

reducing the opening fluid pressure in the inward chamber when the blowout preventer is at least partially open.

23. The method of claim 21, further comprising reducing the opening fluid pressure in the inward chamber when the blowout preventer is at least partially open; and reducing the clutch fluid pressure to allow the clutch plate to engage the locking nut in the at least partially open position.

24. The method of claim 17, further comprising:

reducing the closing fluid pressure when the clutch plate is engaged with the locking nut;

applying closing fluid pressure to the actuator piston from the outward chamber while the clutch plate is engaged with the locking nut;

applying a clutch fluid pressure to the first portion of the clutch piston;

disengaging the clutch plate from the locking nut;

reducing the closing fluid pressure in the outward chamber;

applying an opening fluid pressure to the actuator piston from the inward chamber while the clutch plate is disengaged from the locking nut to at least partially open the blowout preventer.

25. The method of claim 24, further comprising:

reducing the opening fluid pressure in the inward chamber when the blowout preventer is at least partially open.

26. The method of claim 25, further comprising:

reducing the clutch fluid pressure to the first portion of the clutch piston to allow the clutch plate to engage the locking nut in an at least partially open position.

* * * * *